US007533884B1

(12) United States Patent
Padget

(10) Patent No.: US 7,533,884 B1
(45) Date of Patent: May 19, 2009

(54) ANGLING PADDLE AND A PLAYING SURFACE FOR USE AS A TABLETOP GAME

(76) Inventor: Nancy Padget, P.O. Box 946, Kodiak, AK (US) 99615

( * ) Notice: Subject to any disclaimer, the term of this patent is extended or adjusted under 35 U.S.C. 154(b) by 0 days.

(21) Appl. No.: 11/317,929

(22) Filed: Dec. 22, 2005

(51) Int. Cl.
*A63F 7/06* (2006.01)

(52) U.S. Cl. ..... 273/108; 273/108.5

(58) Field of Classification Search ..... 273/108, 273/108.1, 108.4, 108.5, 110, 113, 118 R, 273/119 R, 123 R, 108.51, 108.52, 129 R, 273/129 K, 129 L
See application file for complete search history.

(56) References Cited

U.S. PATENT DOCUMENTS 2,215,687 A * 9/1940 Carter ..... 273/108.52
3,158,373 A * 11/1964 Hastings ..... 273/118 R
3,574,350 A * 4/1971 May ..... 273/108.52
4,271,538 A * 6/1981 Montesi et al. ..... 2/439
4,307,882 A * 12/1981 Hay et al. ..... 273/317
4,765,622 A * 8/1988 Rienzo ..... 273/108.5
5,074,554 A * 12/1991 Ramon, Jr. ..... 473/525
5,372,364 A * 12/1994 Arroyo ..... 273/108.5
5,884,911 A * 3/1999 Guridi ..... 273/119 R

* cited by examiner

*Primary Examiner*—Nini Legesse

(57) ABSTRACT

The invention is a double handled angling paddle for use with a soccer table-top game apparatus, which includes a planar rectangular base area to serve as a playing surface with upstanding sides defining the boundaries of said playing surface, two pair of goal pockets positioned at opposite ends of the playing surface, and a movable object. Two, double-handled angling paddles are used to propel the movable object about on the playing surface.

1 Claim, 6 Drawing Sheets

ANGLING PADDLE AND A PLAYING SURFACE FOR USE AS A TABLETOP GAME

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

The present invention relates to paddles for use with tabletop games and, in particular, to an angleable paddle for use with a soccer game played on a planar surface.

2. Description of the Prior Art

Tabletop soccer games have a tradition of popularity because of the "action" of a fast moving ball, the challenge to the individual player's quickness of response, and the benefit from physical effort to manipulate the various mechanisms used to move the ball.

However, in the prior art, the mechanisms used to propel the ball do not produce sufficient ball speed for a truly fast action game. For example, U.S. Pat. Nos. 5,372,364, 5,092,595 and 4,300,766 use cue sticks, rotating rods and bats, respectively. These apparatus move the ball about, but not at the velocities that would make the game "action packed".

Often, these games have numerous fixed and moveable obstacles that a player's ball must circumvent in order to score a goal. Circumventing obstacles requires skill, as opposed to games that are based more on fast action.

While skill games are fun for many people, they are a different type of game in that skill replaces luck. For people who prefer action and luck to skill, the higher 'skill to luck' ratio of the obstacle type games, diminishes the fun for these players.

Moreover, a player's physical movement is an inherent aspect of the excitement of fast action soccer table type games. However, the prior art is typically limited only to hand movements. These hand movements lack sufficient player's whole body physical workout. Experiencing a substantial physical workout is preferable in any recreational activity.

BRIEF DESCRIPTION OF THE INVENTION

The instant invention overcomes these difficulties. It is a tabletop soccer game played by two people. The soccer game apparatus includes a flat rectangular playing surface surrounded by upright walls. Goal pockets are placed near the four corners. A movable object, such as a ball or puck, is moved by a pair of double handled, angling paddles used by the players to move or strike the movable object upon the playing surface. The goal pockets are large enough to allow the movable object to pass through, thereby making a goal and scoring a point.

A line inscribed on the playing surface, midway between the long ends of the playing surface, defines two secure zones, in which the opposing player cannot use their soccer paddle to seize the movable object.

The double handled, angling soccer paddle has two rods that serve as handles, hinged to a soccer paddle plate. A player holds the one of the rods in each hand. The player then applies force against the rods to angle the paddle, left or right, to propel the movable object across the playing surface. This is accomplished by pushing on one rod and pulling on the other, which causes the face of the paddle to slant at an angle with respect to the movable object. By moving the handles, quickly, the paddle plate is snapped against the ball at a high rate of speed. This snapping action produces a significant force on the ball, which propels it across the playing surface at a high speed.

This striking force against a wood or plastic ball results in ball acceleration to very high velocities across the playing surface, enabling the ball to ricochet against the walls repeatedly about the playing surface.

In use, a player also uses the doubled handled angling soccer paddle to defend the player's goal pockets by blocking either of the two goal pockets located on their end of the playing surface. Either player can capture and manipulate the ball under their control anywhere within their respective secure zone, positioning the ball for a soccer shot towards the opposing player's goal pockets located at the opposing end of the playing surface. A player also may choose to hit the ball while it is in high-speed motion approaching their end of the playing surface.

Defending two goal pockets from a high-speed ball, traveling unimpeded across the playing surface, produces an impulse response from the player. Hence, much of this present invention is played on impulse; therein, resulting in a 'high luck to skill' ratio, yielding much childlike fun trying to keep up with the ball.

Further, if a player engages the full force of both arms, shoulders and upper torso in the application of striking the ball with the double handled angling paddle, they can impact the ball to produce ultra high velocities that rocket the ball across the playing surface.

The objective of each player is to score a goal by causing the ball to enter one of the goal pockets located at the opposite end of the paying surface guarded by the opposing player. The first player to score a set number of goals (e.g., ten goals) is considered the winner.

Half the fun of this game is to keep impacting the ball as hard as possible to keep it moving faster than the opposing player can defend both goal pockets, until the ball either finds a targeted goal pocket, or is captured by the opposing player. This creates a 'frenzy of action' that provides more fun for many players than the games described in the prior art.

With an unobstructed playing surface and a high speed ricocheting ball propelling about the playing surface from the powerful snapping action of the double handled angling soccer paddle, the action of play is fast, challenging, fun and a physically beneficial activity.

DETAILED DESCRIPTION OF THE INVENTION

Figure 1:
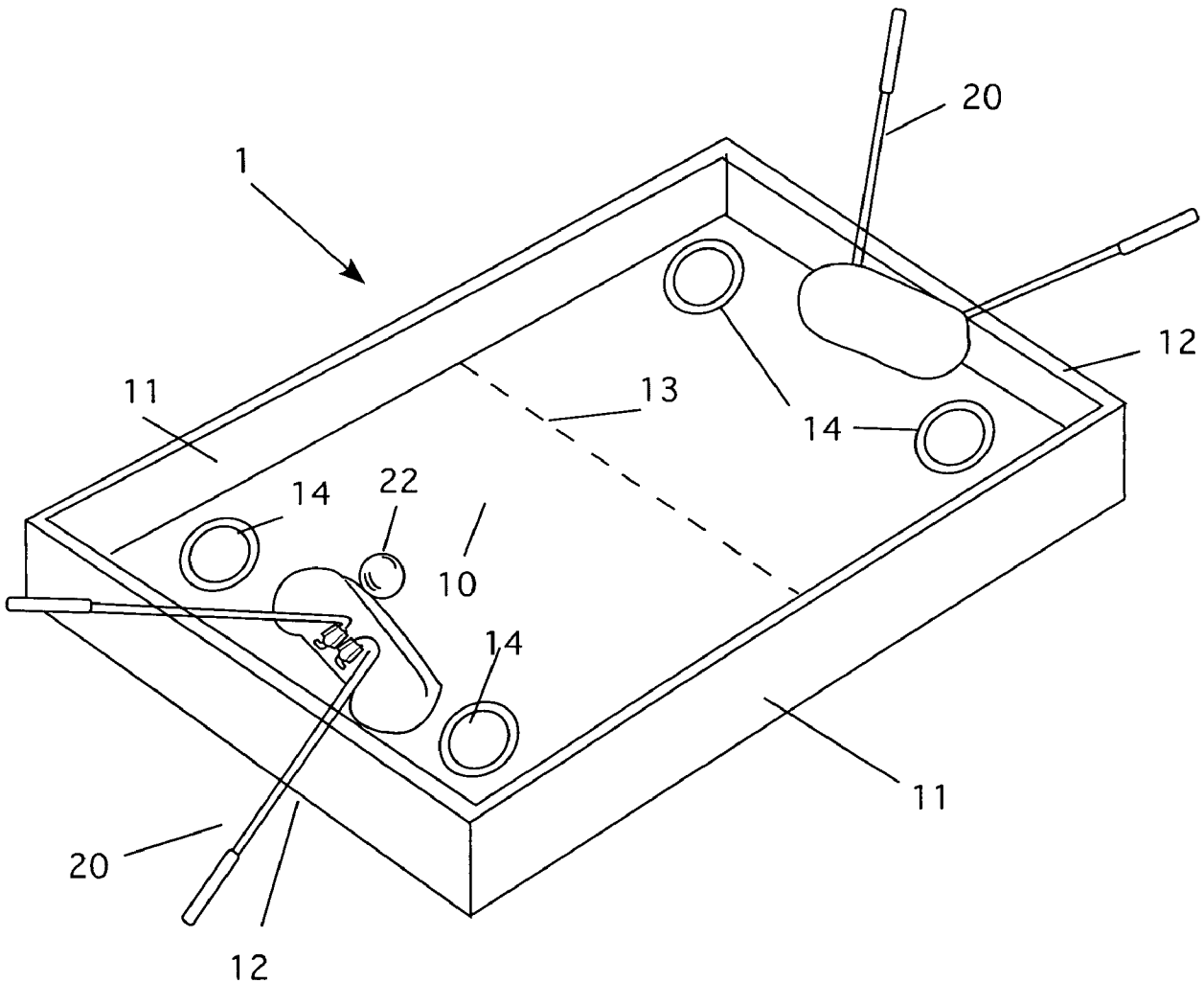
FIG. 1 is a perspective view of a tabletop playing surface of one embodiment of the instant invention.

Referring now to FIG. 1, a first embodiment of the soccer game apparatus 1 of the present invention is shown. It has a flat, generally rectangular playing surface 10 having oppositely disposed peripheral sidewalls 11 and shorter end walls 12 forming a generally rectangular frame around the playing area. In this embodiment, the playing surface 10 has circular apertures 14 that form the goal pockets for receiving the soccer ball 22. In the preferred embodiment, the four goal pockets 14 are positioned around the corners of the playing surface, but spaced apart from the corners as shown.

Note that this figure also shows two paddles 20, one of which is being applied to the ball 22, as would be typical during game play.

A suitable receptacle 28 is positioned beneath the playing surface for retaining the soccer ball after it passes through the respective goal pocket 14. See, e.g., FIG. 7.

A dashed line 13 is inscribed and bisects the playing surface between the end walls 12 to define players' respective secure zone.

The playing surface 10 and walls 11 and 12 may be constructed of wood, plastic or metal. The spherical soccer ball 22 may be made of solid wood, solid plastic, or hollow plastic or a rubber coated material. Although the ball 22 is preferred, it is possible to use other objects on the playing surface as well.

Figure 2:
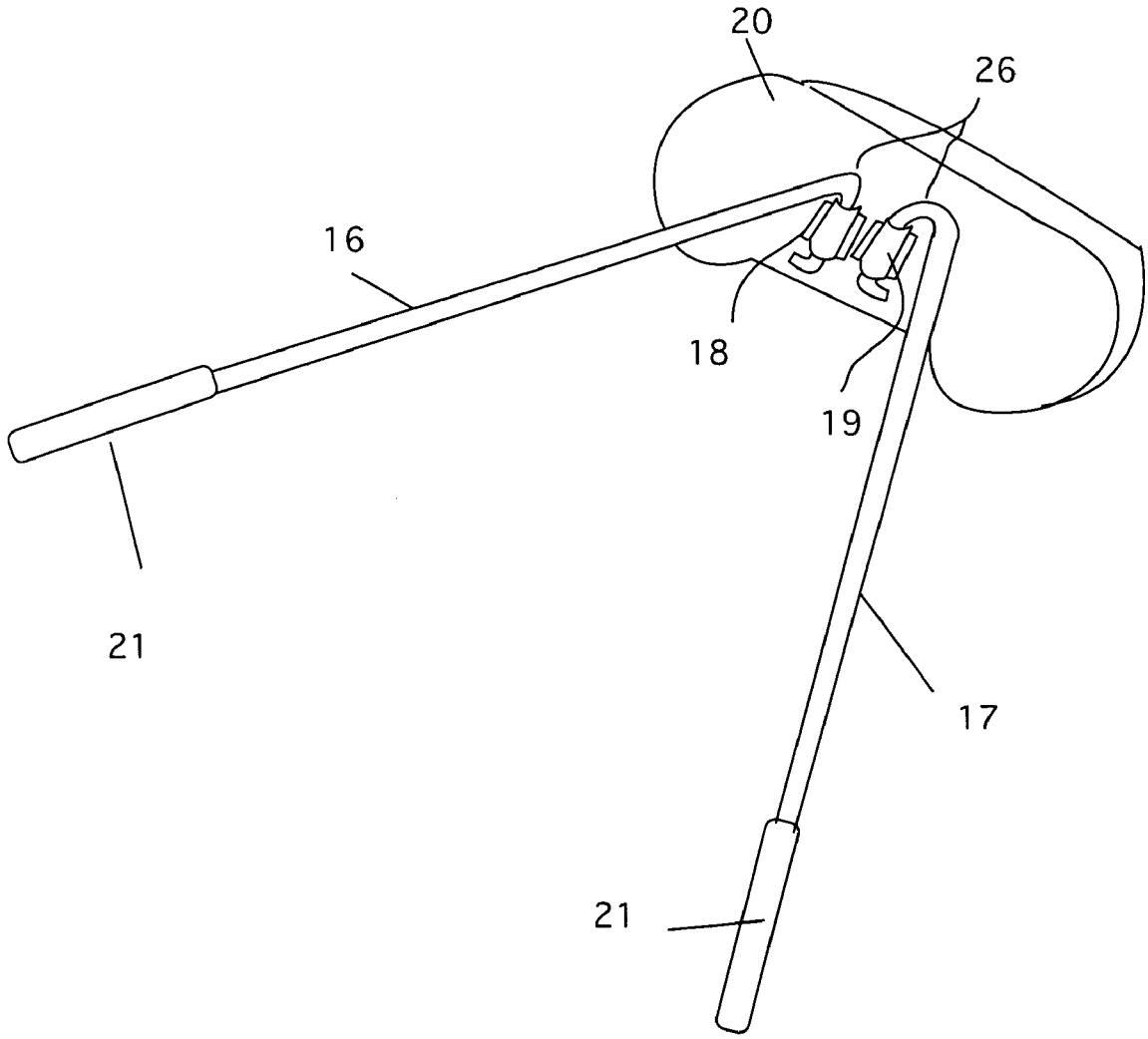
FIG. 2 is a rear perspective view of the double handled angling soccer paddle.

FIG. 2 shows a rear view of one of the doubled handled angling soccer paddles. Each paddle has a pair of rods 16 and 17. The rods 16 and 17 are pivotally connected to the paddle plate 20 by hinges 18 and 19 that act as pivot points. The rods 16 and 17 have grips 21 for the convenience of player gripping. The hinges 18 and 19 can be hinging brackets, as shown in FIG. 2. As shown, two curved metal brackets are provided. The rods 16 and 17 have bent ends 26 that are placed within the curved metal brackets, which are in turn, attached to the back of the paddle plate 20 as shown.

The brackets may be held to the paddle with screws or other fasteners known in the art. These hinges provide a good hinging action, good mechanical integrity, and ease of manufacture. However, other hinges or pivot point type structures can be used. These types of hinges are well known in the art. Note that the hinges are placed close together, as shown, in the preferred embodiment. In this way, the rods can impart the greatest amount of "snapping" action that propels the ball at a high rate of speed.

The paddle plate 20, the rods 16 and 17 and the hinges 18 and 19, should be made of strong material, e.g., wood, metal, plastic or a combination thereof.

The shape of the paddle plate 20 is generally broad enough and high enough to strike a ball from either side of its outer faces, narrow enough to be light in weight, and strong and durable enough to sustain the shock from impacting a solid wood or solid plastic ball. Within the previously mentioned guidelines, the specific shape or curvature of the paddle plate 20 is relatively unimportant.

Figure 3:
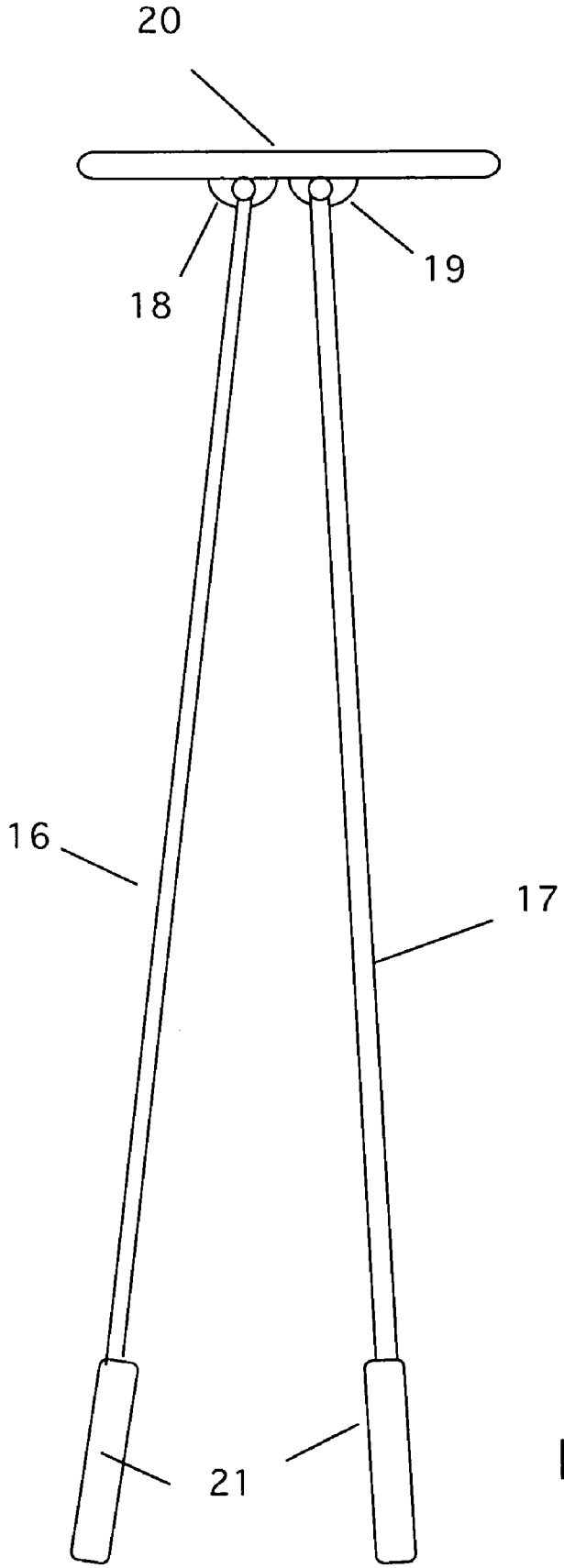
FIG. 3 is a top view of the double handled angling soccer paddle in a first position.

FIG. 3 shows the paddle in a neutral position. In this position, the paddle 20 is parallel with the centerline 13 of the table. This is a position in which a player attempts to defend a goal pocket from a fast approaching soccer ball.

Figure 4:
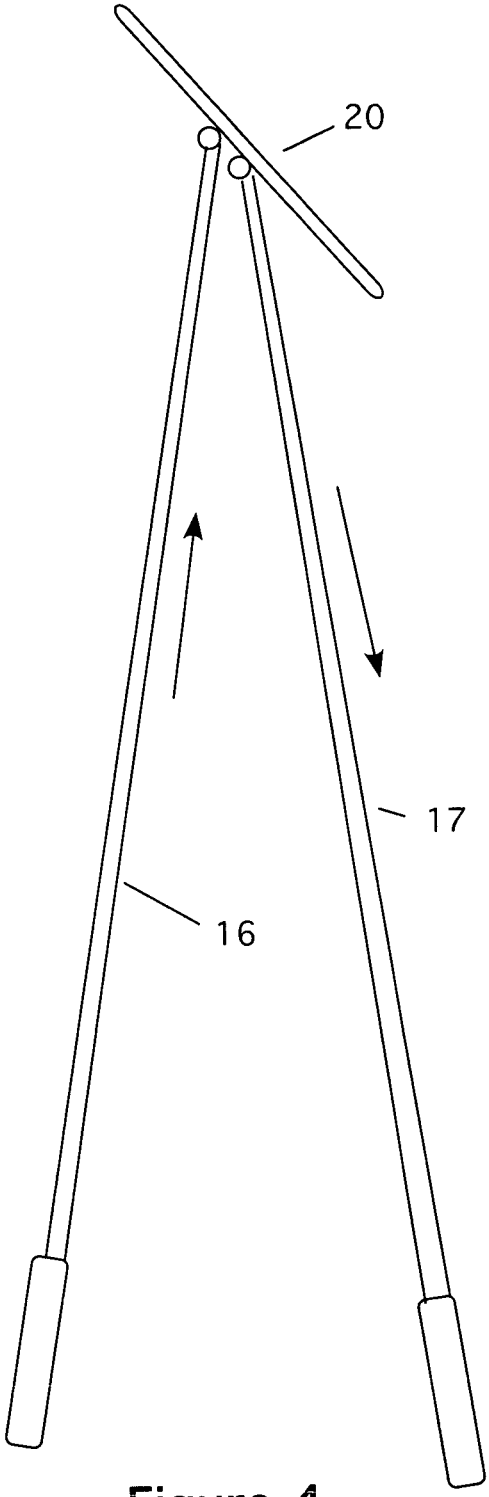
FIG. 4 is a top view of the double handled angling soccer paddle in a second position.
Figure 5:
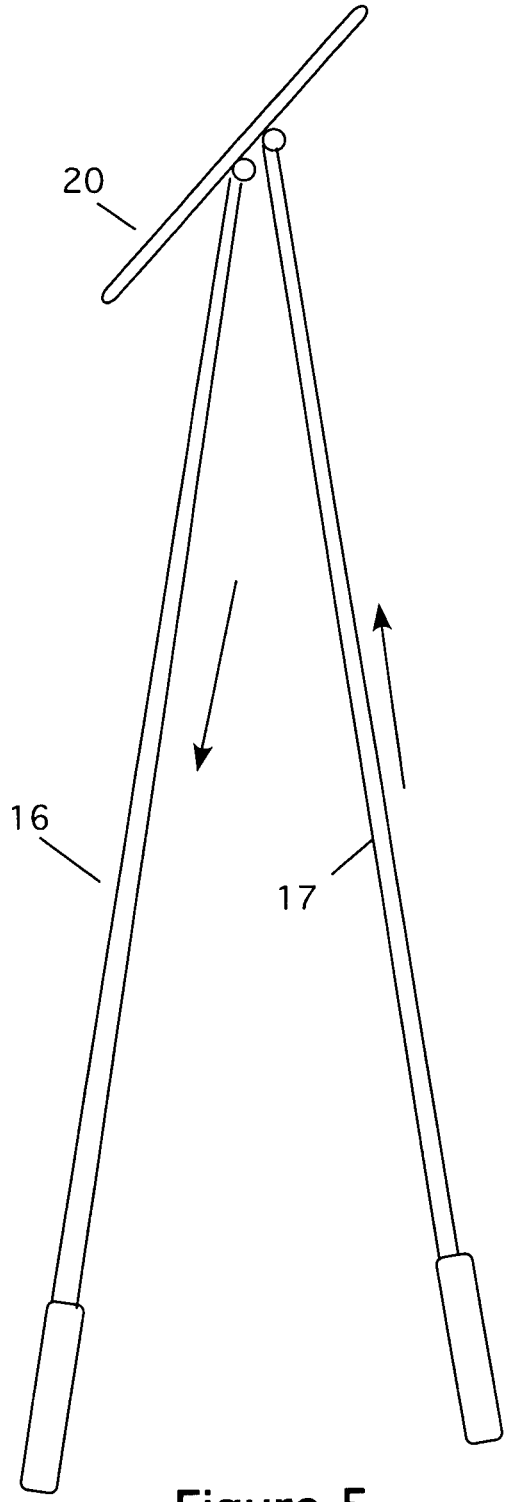
FIG. 5 is a top view of the double handled angling soccer paddle in a third position.

FIGS. 4 and 5 show the extreme angled positions of the paddle 20. These positions result from a swift push/pull motion of rods 16 and 17. For example, in FIG. 4, rod 16 is quickly pushed forward and rod 17 is simultaneously pulled back quickly. In FIG. 5, the motion is opposite to that of FIG. 4. As noted above, this action produces a snapping of the paddle plate 20.

The snapping movement of the rods produces a forceful impact against a ball that is positioned on the outer surface of the paddle plate 20. This force then propels the ball in whatever direction is established by the particular angle of the rods. Note that FIGS. 4 and 5 show the extreme angles. During play, at any given time, the angles may be reduced to produce a different trajectory. Moreover, under actual playing conditions, the ball is moving very quickly. This causes an impulse reaction on the part of the player that, in turn, produces somewhat unpredictable ball movement. With practice, a player can learn to angle the ball, thereby setting up more chances to score points.

Figure 6:
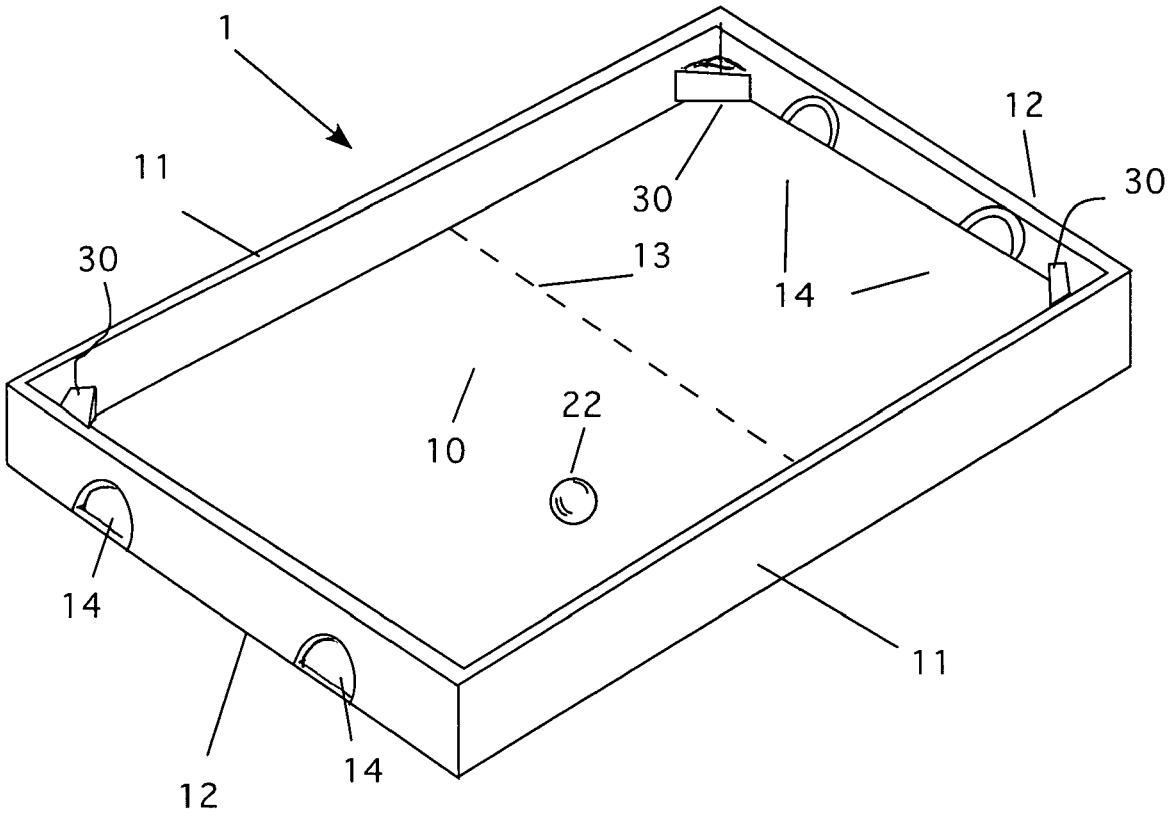
FIG. 6 is a perspective view of a tabletop playing surface of a second embodiment of the instant invention.

Although the paddles are best used on a tabletop game as shown in FIG. 1, with the goal pockets not in the corners, it is possible to use the paddles on other game surfaces. For example, FIG. 6 is a perspective view of a second embodiment of the tabletop-playing surface. In this embodiment, the table surface and 10 sidewalls 11 and 12 are identical to that of the first embodiment. Here, however, the goal pockets 14 are formed in the end walls 12, instead of being in the playing surface as before. This figure also shows diagonal braces 30 that provide additional strength as well as providing additional deflecting surfaces for the ball.

Figure 7:
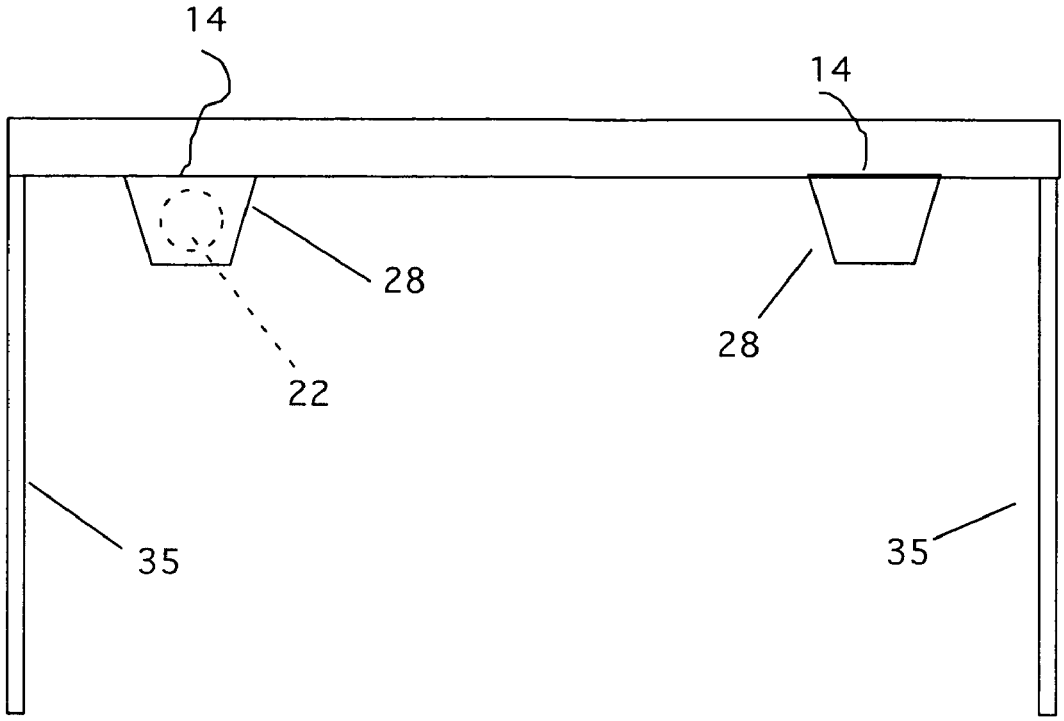
FIG. 7 is a side elevation view of the tabletop playing surface showing the goal pockets and support legs.

FIG. 7 is a side elevation view of the tabletop playing surface showing the goal pockets 28 and support legs 35. As mentioned above, the goal pockets 14 have receptacles 28 that attach to the bottom of the playing surface 10. Of course, the placement of the receptacles would vary, depending on the exact placement of the goal pockets shown in the different embodiments. Such changes are well within the art. This figure also shows a ball 22 in one of the receptacles 28. Finally, legs 35 are shown positioned on the corners of the tabletop. The legs permit the game to be freestanding and are designed to hold the tabletop at a convenient playing height.

Figure 8:
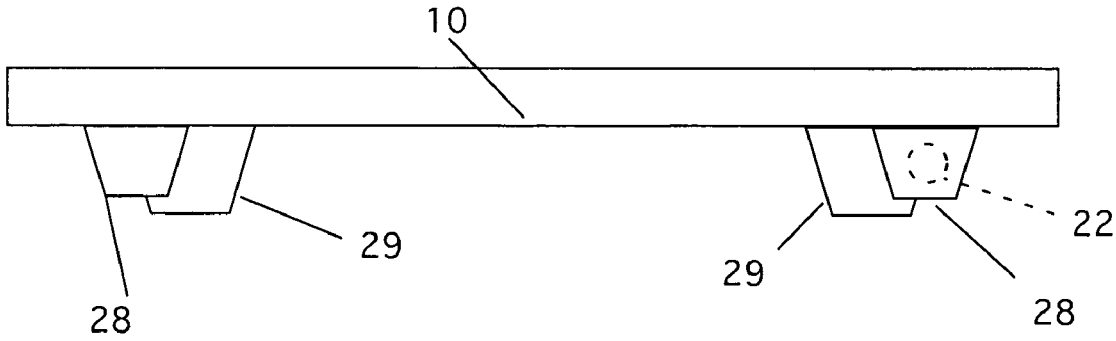
FIG. 8 is a side elevation view of the tabletop playing surface showing the goal pockets and support legs for use on a tabletop.

FIG. 8 is a side elevation view of the tabletop playing surface showing the goal pockets 28 and support legs 29 for use on a tabletop. Here, the legs 29 are short and are designed to hold the game table up off a surface, such as a large table. This provides space for the receptacles 28 to fit under the table surface as shown.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A tabletop soccer game apparatus comprising:

a) a flat rectangular playing surface surrounded by upright walls and a line inscribed on said playing surface midway between the long ends of the playing surface, defining two secure zones;

b) a spherical moveable object propelled on said flat rectangular playing surface;

c) two double-handled angling paddles for use on the tabletop playing surface, each paddle comprising: a paddle plate, being generally rectangular and having a front surface and a back surface; a pair of rods, each pivotally affixed to said back surface of said paddle plate to serve as handles for said double-handled angling paddle; said pair of rods, pivotally affixed to said paddle plate in close proximity to one another and centrally located on said back surface of said paddle plate, whereby; a simultaneous push-pull force applied to said pair of rods in parallel, creates a snapping angling action of said paddle plate "left" or "right" from a "neutral" position; said pair of rods pivotally connected to said paddle plate by means of hinges; said pair of rods affixed in the same plane extending outwardly from the said back surface of said paddle plate, approximately perpendicular to the said paddle plate plane, wherein the double-handled angling paddles are freely positionable anywhere within the respective said secure zone of the said flat rectangular playing surface, to capture and manipulate said spherical moveable object;

d) four apertures, for use as goal pockets, each one of said apertures placed near the corners of said upright walls.

* * * * *